United States Patent [19]

Hoshi

[11] 4,078,528

[45] Mar. 14, 1978

[54] FUEL FEED CONTROL DEVICE FOR INTERNAL COMBUSTION ENGINE

[75] Inventor: Yoshikazu Hoshi, Hitachi, Japan

[73] Assignee: Hitachi, Ltd., Japan

[21] Appl. No.: 589,692

[22] Filed: Jun. 24, 1975

Related U.S. Application Data

[63] Continuation-in-part of Ser. No. 331,074, Feb. 9, 1973, abandoned.

[30] Foreign Application Priority Data

Mar. 3, 1972 Japan ..... 47-21504

[51] Int. Cl.[2] ..... F02B 3/00

[52] U.S. Cl. ..... 123/32 EF; 361/160

[58] Field of Search ..... 123/32 EA, 32 AE, 32 EF; 317/DIG. 4, DIG. 6, 148.5

[56] References Cited

U.S. PATENT DOCUMENTS

| | | | |
|---|---|---|---|
| 2,077,259 | 4/1937 | Planiol | 123/32 EA |
| 3,021,454 | 2/1962 | Pickens | 123/32 AE |
| 3,396,314 | 8/1968 | Corson | 317/DIG. 6 |
| 3,433,207 | 3/1969 | Bassot et al. | 123/32 EF |
| 3,465,731 | 9/1969 | Bassot | 123/32 EA |
| 3,702,425 | 11/1972 | Hoffmann | 317/DIG. 6 |
| 3,942,485 | 3/1976 | Suda | 123/32 EA |

*Primary Examiner*—Ronald B. Cox
*Attorney, Agent, or Firm*—Craig & Antonelli

[57] ABSTRACT

A fuel feed control device for an internal combustion engine comprising an electromagnetic valve for controlling the fuel quantity to be fed to the internal combustion engine according to the opening duration of the valve, in which the valve is adapted to be energized to be held in its open state with a holding current, the holding current being large enough to hold the valve in its open state after the valve has been once rendered open but not enough to render the valve open from its closed state and having been applied to the valve before the valve is rendered open from its closed state, and energized to be rendered open from its closed state with a valve opening current along with the holding current, the valve opening current being applied to the valve for a pregiven duration so as to additionally co-operate with the holding current, and, further, when the valve is rendered closed from its open state, the valve is energized with a control current, for a desired duration from the instant when the holding current is cut off, so as to produce backward magnetic flux to cancel the forward magnetic flux induced at the instant when the holding current is cut off, whereby the control device may be improved in the responsiveness in the opening and closing operation of the injection valve.

2 Claims, 16 Drawing Figures

FUEL FEED CONTROL DEVICE FOR INTERNAL COMBUSTION ENGINE

CROSS-REFERRENCES TO RELATED APPLICATION

This application is a continuation-in-part application of our copending application, Ser. No. 331,074 filed on Feb. 9, 1973, now abandoned.

This invention relates to a fuel feed control device for an internal combustion engine, particularly to an improvement in the responsiveness of an electromagnetic valve utilized as means for controlling fuel feed quantity in a fuel feed control device. The fuel feed control device can control the fuel feed quantity with high accuracy.

Two different types of control valves are known for use in a fuel feed control device for an internal combustion engine, in which a fuel injection nozzle is disposed to be opened into a suction pipe of the internal combustion engine so that the engine is fed with desired fuel quantity by controlling the opening duration of the control valve. One of the two types of control valves is driven mechanically and another electromagnetically.

In recent years, a fuel feed control device using the latter type of the controlled valve, namely an electromagnetic valve, has become more advantageous than the former because of the ease in detecting various control factors, the ease in determinating the quantity to be controlled, and the improvement in the control elements including semiconductive parts and the like.

The most serious trouble which reduces the accuracy of the control operation in a fuel feed control device using an electromagnetic valve is a time lag of the responsiveness in opening and closing operation of the electromagnetic valve among troubles due to various errors, for example errors in detecting process of various control factors, errors in computing process, and deviation of fuel feed pressure and the like.

The opening duration of a fuel injection valve, which is used in an internal combustion engine as a fuel feed means, is determined so that a suitable quantity of fuel is fed into the engine according to the number of revolution and the load thereof.

However, since the number of revolutions of an internal combustion engine varies extending over a wide range from about 600 r.p.m. to 6000 r.p.m., the occurrence of the unsuitability in the fuel quantity fed to the engine leads to the reducing of the operation efficiency of the engine. This is undesirable particularly in view of the increasing of harmful exhaust gas. In practice, however, a time lag occurs in the process of the opening and closing operation of an electromagnetic valve, which is used as a fuel injection valve, when the engine is running in a high speed, with the result that the fuel feed quantity is apt to be inaccurate.

It is a general object of the present invention to improve the responsiveness in opening and closing operation of an electromagnetic valve for use in a fuel feed control device to thereby improve the accuracy of the fuel feed control and enable the control device to be applicable to a high speed engine.

It is also an object of the present invention to provide a fuel feed control device for an internal combustion engine comprising a normally closed fuel injection valve for controlling the fuel quantity to be fed to the engine according to the opening duration thereof; and means for electromagnetically controlling the opening and closing operation of said valve in the manner so that said means is energized so as to produce a first electromagnetic attraction force which is large enough to render said valve open from its closed state, energized so as to produce a second electromagnetic attraction force which is large enough to hold said valve in its open state after once said valve has been opened, and energized so as to produce backward magnetic flux thereby cancelling the induced magnetic flux which prevents said second electromagnetic attraction force from disappearing when said valve is rendered closed from its open state.

The foregoing objects and other objects as well as characteristic features of the invention will become more apparent and more readily understandable by the following description and the appended claims when read in conjunction with the accompanying drawings, in which:

Figure 5:
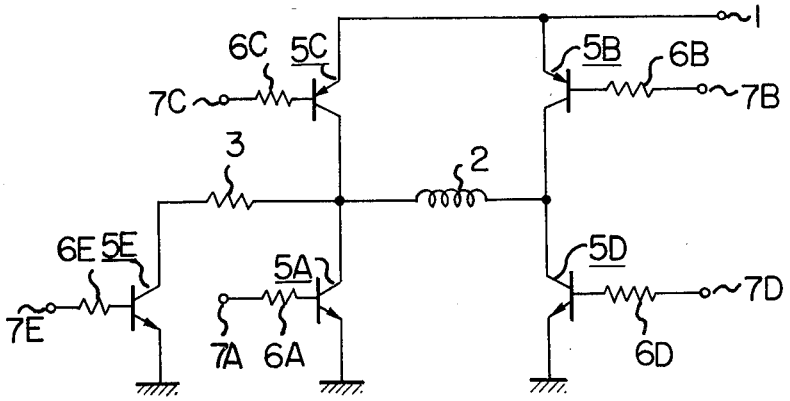
Figure 6:
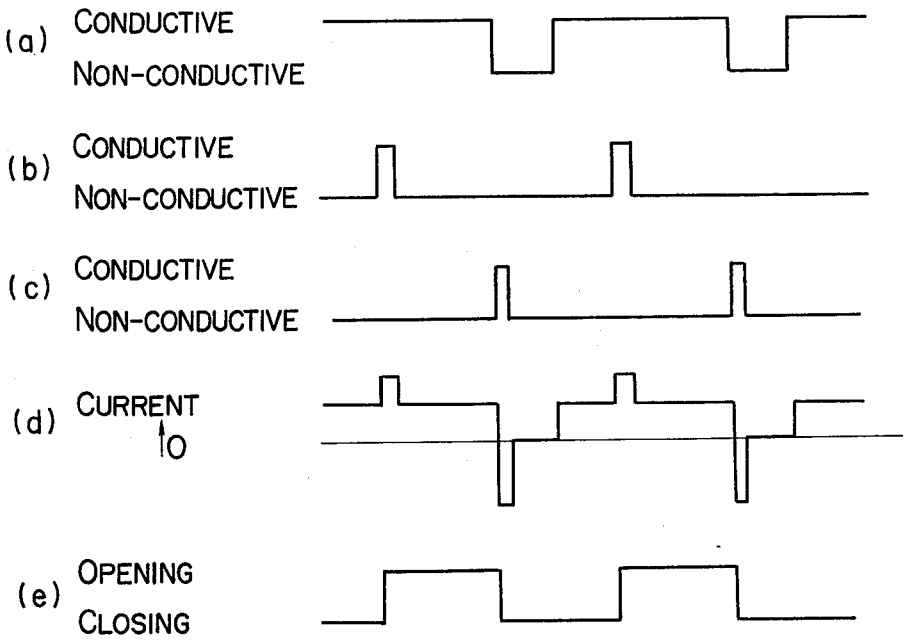
Figure 7:
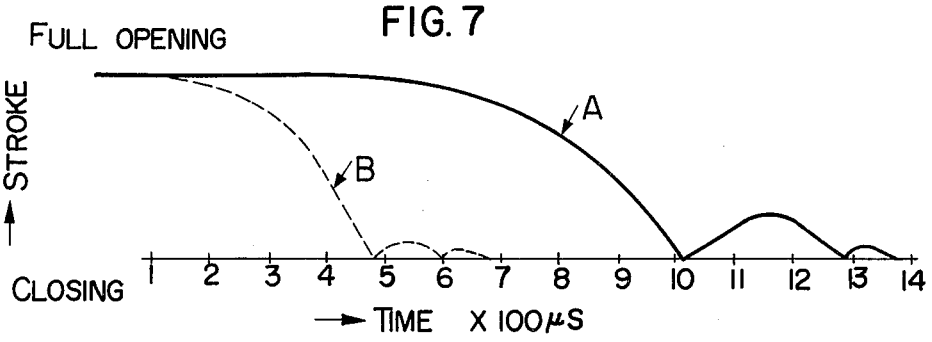
Figure 11:
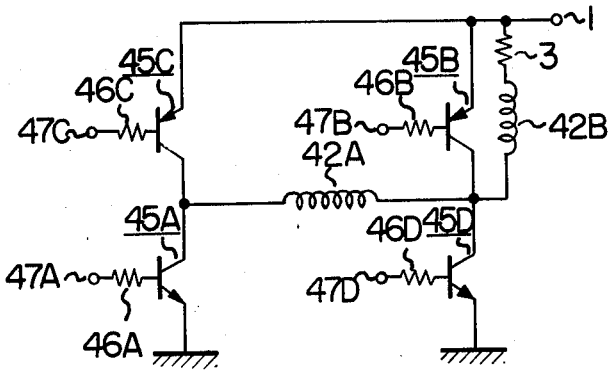
Figure 12:
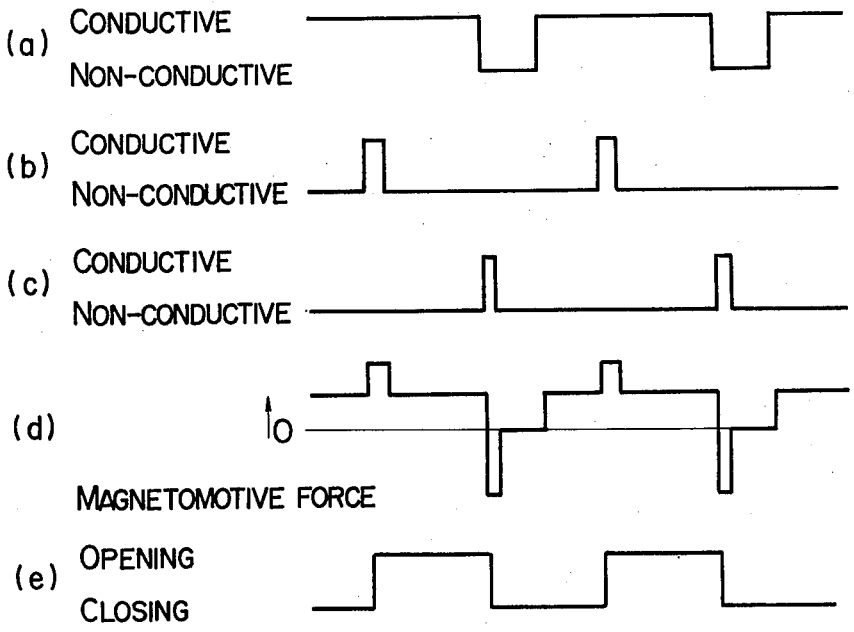
Figure 13:
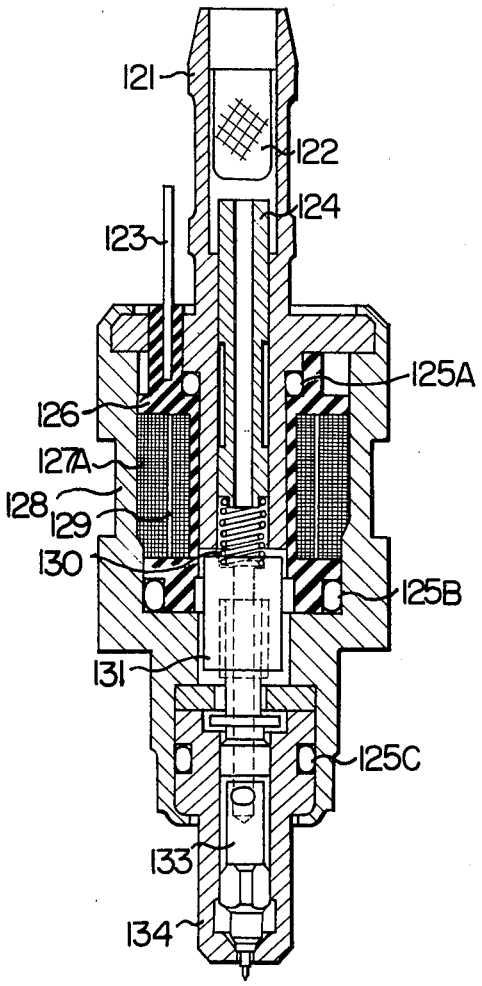
Figure 14:
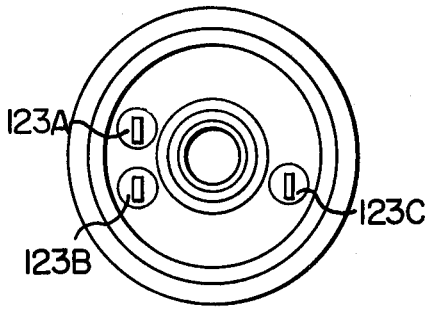
Figure 15:
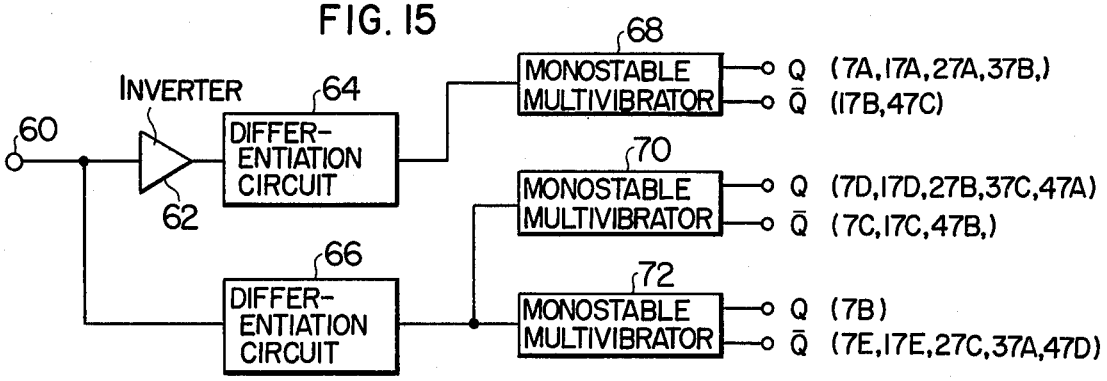
Figure 16:
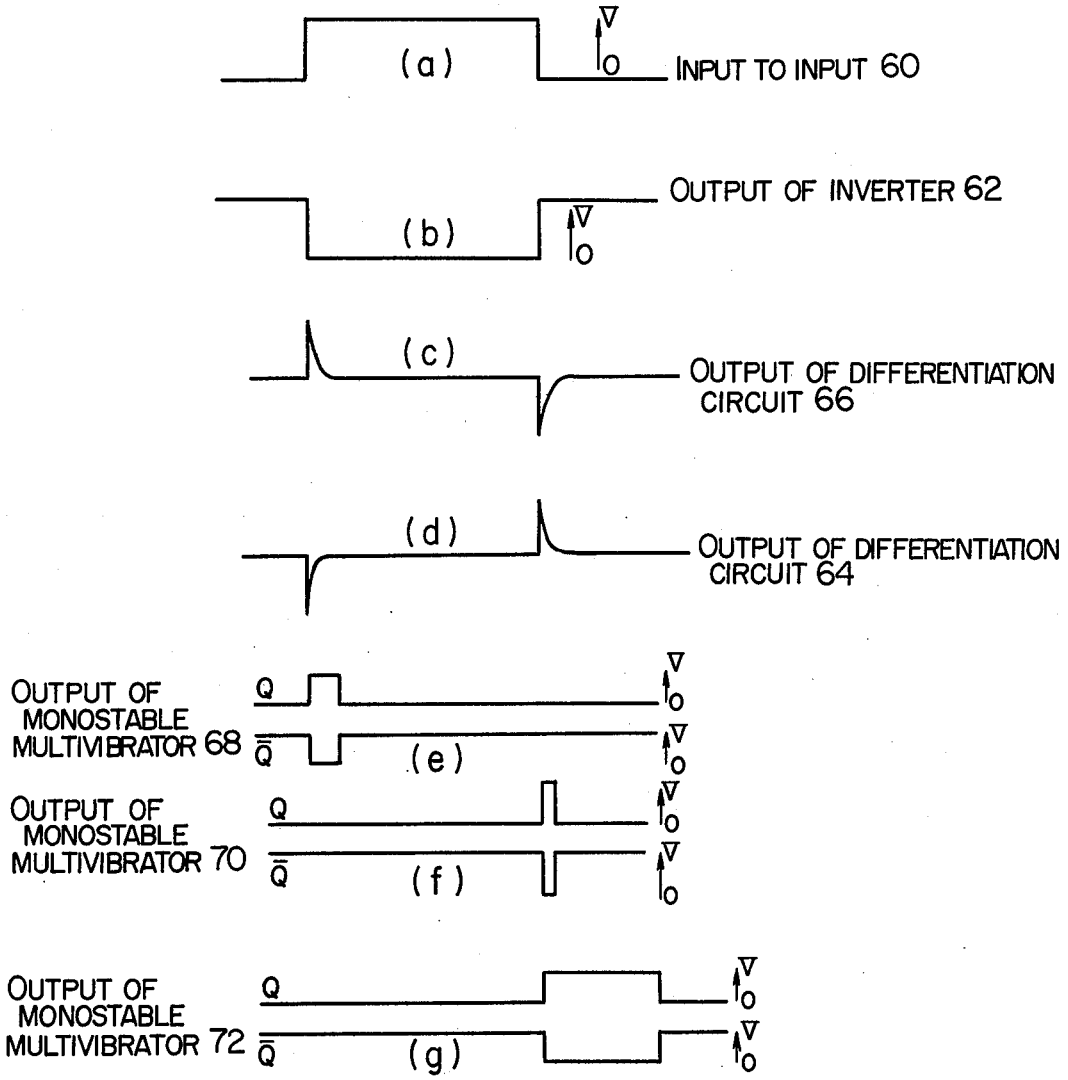

FIGS. 5, 8, 9, and 10 show electric circuits of other embodiments of this invention;

FIG. 6 is an explanatory drawing illustrating the operation state of the respective electric circuits shown in FIGS. 5, 8, 9, and 10;

FIG. 7 shows a characteristic curve illustrating the function of the embodied device of the present invention in the process of the valve closing operation;

FIG. 11 shows an electric circuit of a further embodiment of this invention;

FIG. 12 is an explanatory drawing illustrating the operation state of the electric curcuit shown in FIG. 11;

FIG. 13 is a sectional view showing the structure of an electromagnetic valve of an embodiment of this invention;

FIG. 14 is a plan view of the electromagnetic valve shown in FIG. 13;

FIG. 15 is a block diagram showing a circuit for providing the controll signals to be used for the embodiments of FIGS. 8, 9, 10 and 11; and FIG. 16 is an explanatory drawing illustrating the operation state of the circuit shown in FIG. 15.

Figure 1:
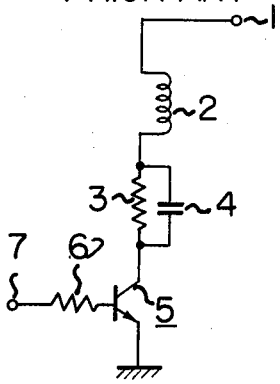
FIG.1 PRIOR ART
FIG. 1 shows a known electric circuit for driving an electromagnetic valve.

Referring to FIG. 1, a series circuit consisting of electromagnetic coil 2, a resistor 3, and the collector-emitter circuit of a transistor 5 is connected between an electric power supply terminal 1 and an earth, and the base electrode of the transistor 5 is connected to a control signal input terminal 7 through a resistor 6, while a capacitor 4 is connected in parallel with the resistor 3.

In the above circuit, the inner resistance between the collector and emitter electrodes of the transistor 5 is controlled by supplying a bias voltage to the base electrode of the transistor 5 from the control signal input terminal 7, so that the opening and closing operation of an electromagnetic valve for controlling the fuel feed quantity can be controlled.

Because the capacitor 4 is connected in parallel with the current limiting resistor 3, the electromagnetic coil 2 is energized to open the electromagnetic valve by a large current passing through the coil 2 and the capacitor 4 for a transient duration when the valve is rendered open, and, after the charging of the capacitor 4 has been completed, the coil 2 is energized by a current which is large enough to hold the open state of the valve and called a holding current hereinafter.

Even if the holding current is removed from the coil 2 to render the valve closed, the valve is not completely closed immediately. This is because a counter electromotive force is induced in the electromagnetic coil when the holding current is removed from the coil and, at the same time, an eddy current is also induced in the magnetic material constituting a magnetic circuit for the electromagnetic valve in a manner so that the magnetic flux which has been induced by the holding current is prevented from disappearing. These counter electromotive force and eddy current are gradually reduced with time with the result that the magnetic attraction force of the valve which has been prevented by those counter electromotive force and eddy current from disappearing is also gradually reduced with time according to the reducing of those counter electromotive force and eddy current.

As a result, the valve is kept in the fully open state until the electromagnetic attraction force is reduced to be equal to the force for closing the valve which is usually given by a spring means or the like, and then the degree of the prevention of the closing operation of the valve is gradually reduced so as to completely close the electromagnetic valve.

The time required for the closing operation of the valve changes in connection with the magnitude of the force of the spring for closing the valve and the inertia of the movable portion of the valve, etc.

The embodiment shown in FIG. 1 intends to improve the responsiveness in the valve opening operation by passing a sufficiently large current through the electromagnetic coil when the valve is rendered open from the closed state thereof well as the responsiveness in the valve closing operation by reducing the production of the above-mentioned counter electromotive force and addy current as much as possible when the valve is rendered closed from the open state thereof. The above-mentioned counter electromotive force and eddy current can be somewhat prevented from being induced by holding the valve with a reduced holding current in its open state.

Figure 2:
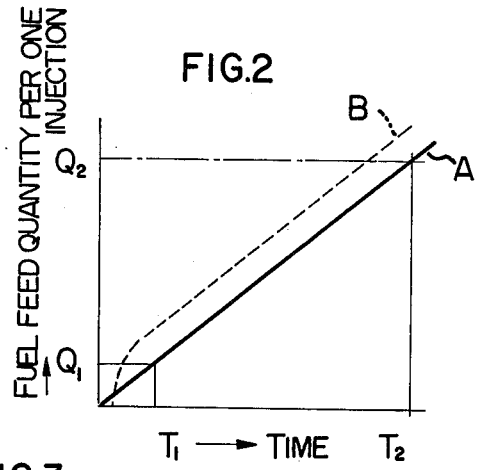
FIG. 2 shows fuel feed quantity characteristic curves.

FIG. 2 shows the characteristic curves illustrating the relation-ship between the fuel feed quantity per one injection and the damanded time for opening the electromagnetic valve, in which the curve A represents an ideal state of the device having no time lag in response in the process of the opening and closing operation of the valve and the curve B a practical state having a time lag.

If a fuel feed control device has such an ideal characteristic as shown by the curve A, the electromagnetic valve can be immediately fully opened in response to a demand signal for opening the valve with high responsiveness and immediately closed when the demand signal is delected even if the demanded time is very short. As a result, the relationship between the demanded time and the fuel feed quantity per one fuel injection varies linearly.

One the other hand, in practice as shown by the curve B, the electromagnetic valve cannot be opened at all if the demanded time for opening the valve is very short. Even if the demanded time is increased a little, the demand signal may be deleted to close the electromagnetic valve before it becomes fully open. Accordingly, the relationship between the fuel feed quantity per one injection and the demanded time varies non-linearly. The electromagnetic valve may be fully opened if demanded time is further increased. On the other hand, in this event, the valve may be kept in its open state when the demand signal is delected if the response of the valve closing operation is somewhat slow resulting in the increasing of the fuel feed quantity more than in the case where such responsiveness is high in response to the same demanded time for opening the valve.

In a fuel feed control device using an electromagnetic valve having such a characteristic as shown by the curve A in FIG. 2, it is relatively easy to control a desired fuel feed quantity between the necessary minimum value Q1 and the necessary maximum value Q2 in the period for controlling the fuel feed quantity between the minimum value T1 and the maximum value T2 because of the linear relationship between the demanded time and the fuel feed quantity per one fuel injection. Further, it is possible to make the maximum value Q2 large, while the maximum value T2 remains as it is, or to make the maximum value T2 small, while the maximum value Q2 remains as it is, or to make the maximum values Q2 and T2 large and small respectively, at the same time, by increasing the fuel feed pressure or enlarging the mechanical dimension of the fuel measuring member of the device, etc.

On the contrary, in a fuel feed control device comprising an electromagnetic valve having such a characteristic as shown by the curve B in FIG. 2, the demanded time to be required for opening the valve corresponding to the necessary minimum value Q1 exists in a non-linear portion of the characteristic curve B, resulting in the complication of the control device and the reduction of the accuracy in the control operation. It is possible, of course, to make the maximum value Q2 large, while the maximum value T2 remains as it is, or to make the maximum value T2 small, while the maximum value Q2 remains as it is, or to make the maximum value Q2 and T2 large and small respectively at the same time, in the same manner as above, namely by increasing the fuel feed pressure or enlarging the mechanical dimension of the fuel measuring member of the device, etc. However, even if the above requirement can be thus satisfied by increasing the fuel feed quantity per unit time near the maximum value Q2, the non-linear portion near the minimum value Q1 is enlarged with the result that the accuracy in the control operation may be greatly reduced or, sometimes, it may become impossible to perform the control operation.

To resolve the above problem, it is required to improve the responsiveness in valve closing operation taking a serious view thereof to the same extent as the improvement in the responsiveness in the valve opening operation.

Figure 3:
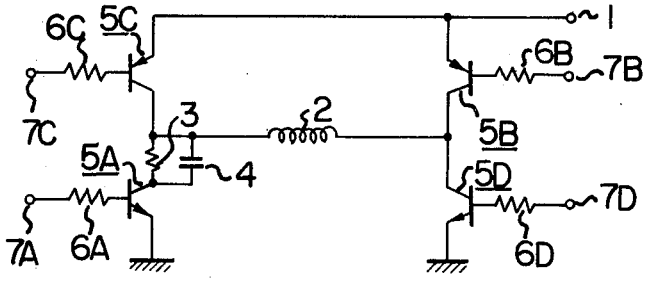
FIG. 3 shows an electric circuit of an embodiment of this invention.

FIG. 3 shows an electric circuit of an embodiment of the present invention, the purpose of which is to improve the responsiveness in opening and closing operation of the valve. The circuit shown in FIG. 1 mainly aims at the improvement in the responsiveness in valve opening operation and can be replaced by the circuit according to the invention and shown in FIG. 3 so that the responsiveness in valve closing operation can be improved as well as the responsiveness in valve opening operation.

In the electrical circuit shown in FIG. 3, a series circuit consisting of the respective collector-emitter circuits of transistors 5B and 5D is connected between an electric power supply terminal 1 and earth. The transistor 5B is used for additionally controlling the valve opening current which produces a necessary electromagnetic force for opening the valve from its closed state. The direction of the current flowing in the electromagnetic coil so as to induce the above-mentioned electromagnetic force is called the forward direction hereinafter, and hence such current is called a forward current. The transistor 5D serves for controlling the backward current flowing in the coil 2. Further, another series circuit consisting of the collector-emitter circuit of a transistor 5C, a current limiting resistor 3, and the collector-emitter circuit of a transistor 5A is also connected between the electric power supply terminal 1 and earth, the transistors 5C and 5A being used for additionally controlling the backward current and for controlling the valve opening current respectively. A capacitor 4 is connected in parallel with the resistor 3, and an electromagnetic coil 2 is connected between the respective collector electrodes of the transistors 5B and 5C. The base electrodes of the transistors 5A, 5B, 5C and 5D are connected to control signal input terminals 7A, 7B, 7C and 7D through resistors 6A, 6B, 6C and 6D respectively.

Figure 4:
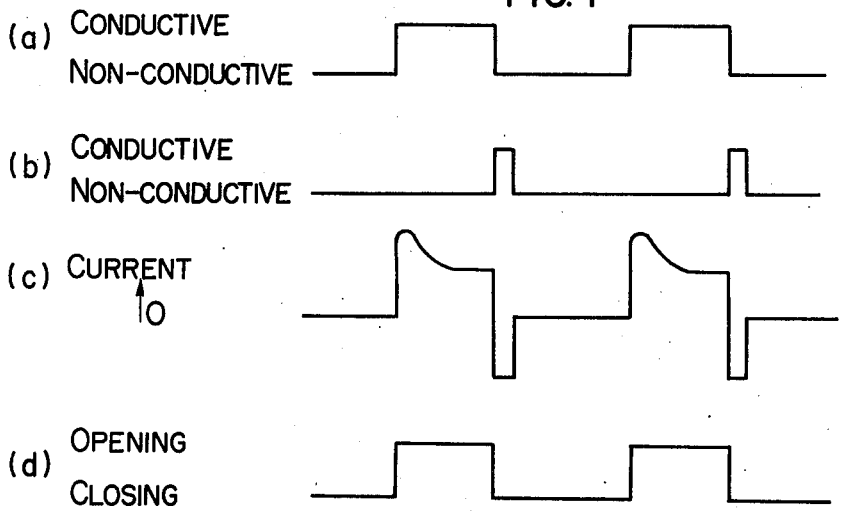
FIG. 4 is an explanatory drawing illustrating the operation state of the electric circuit show in FIG. 3.

FIG. 4 illustrates the operation state of the circuit shown in FIG. 3. The transistors 5A and 5B are controlled to function in agreement with the pattern shown in FIG. 4*a* and the transistors 5C and 5D are controlled to function in agreement with the pattern shown in FIG. 4*b*. Thus controlled, when the valve is rendered open, both the transistors 5A and 5B become conductive so that a large current passes through the electromagnetic coil 2 thereby actuating the electromagnetic valve to be opened at the beginning and the current is gradually decreased until it becomes a constant value. When the required valve opening time has been passsed, the transistors 5B and 5A and the transistors 5C and 5D are caused to become non-conductive and conductive respectively, and then the transistors 5C and 5D are caused to become non-conductive again after a given time.

Accordingly, such a current as shown in FIG. 4*c* flows through the electromagnetic coil. Namely, when the electromagnetic valve is rendered open, a current flows from the terminal 1 to earth through the emitter-collector circuit of the transistor 5B, the electromagnetic coil 2, the parallel circuit consisting of the current limiting resistor 3 and the capacitor 4, and the collector-emitter circuit of the transistor 5A in turn. In the parallel circuit of the resistor 3 and the capacitor 4, the current flowing through the capacitor 4 is of course, gradually decreased with time to be zero, while it is very large at the beginning of the valve opening operation.

On the contrary, when the electromagnetic valve is rendered closed the current control transistors 5A and 5B are rendered non-conductive so as to prevent the forward current from flowing through the electromagnetic coil 2 and, at the same time, the backward current control auxiliary transistor 5C and the forward current control transistor 5D are rendered conductive to pass a backward current from the terminal 1 to earth through the transistor 5C, the electromagnetic coil 2 and the transistor 5D in turn. Since the backward current flows through the coil 2 in the opposite direction to the forward current which flows during the opening of the valve, it serves to reduce the electromotive force induced by cutting off the forward current for holding the open state of the valve and an eddy current induced in such a manner as to prevent the flux due to the forward current from disappearing when the forward current is caused to be cut off. Accordingly, the electromagnetic attraction force of the valve can be rapidly eliminated to close the valve immediately and completely, with the result that the responsiveness in valve closing operation can be greatly improved. The electromagnetic valve is controlled to be opened or closed in agreement with the pattern of FIG. 4*d*, wherein the responsiveness in opening and closing operation of the valve is neglected.

FIG. 5 shows an electric circuit of an embodiment according to the invention, in which a series circuit consisting of the emitter-collector circuit of a forward current control auxiliary transistor 5B and the collector-emitter circuit of a backward current control transistor 5D is connected between an electric power supply terminal 1 and earth and another series circuit consisting of the emitter-collector circuit of a backward current control auxiliary transistor 5C and the collector-emitter circuit of a forward current control trnsistor 5A is also connected between the terminal 1 and earth. Electromagnetic coil 2 is connected between the junction point of the two collector electrodes of the transistors 5B and 5D and the junction point of the two collector electrodes of the transistors 5A and 5C. Further, another series circuit consisting of a holding current limiting resistor 3 and the collector-emitter circuit of a holding current control transistor 5E is connected in parallel with the collector-emitter circuit of the transistor 5A and the base electrodes of the transistors 5A, 5B, 5C, 5D and 5E are connected to control signal input terminals 7A, 7B, 7C, 7D and 7E through resistors 6A, 6B, 6C, 6D and 6E respectively.

FIG. 6 shows the operation state of the circuit shown in FIG. 5. The forward current control auxiliary transistor 5B, the holding current control transistor 5E, the valve opening control transistor 5A, the backward current control auxiliary transistor 5C and the backward current control transistor 5D are controlled to function respectively in agreement with the patterns of FIG. 6*a*, FIG. 6*a*, FIG. 6*b*, FIG. 6*c* and FIG. 6*c*.

As a result, since only the forward current control auxiliary transistor 5B and the holding current control transistor 5E are conductive at the beginning, a current flows from the electrical power supply terminal 1 to earth through the forward current control auxiliary transistor 5B, the electromagnetic coil 2, the holding current limiting resistor 3 and the holding current control transistor 5E. This current produces an electromagnetic force which cannot render the valve open from its closed state but can hold its open state once the valve is opened.

Then, the valve opening control transistor 5A is rendered conductive, so that a large forward current flows through the path of the forward current control auxiliary transistor 5B, the electromagnetic coil 2, and the valve opening control transistor 5A. Therefore, in this time, it is not always necessary that the holding current control transistor 5E is conductive. The valve opening transistor 5A is controlled to be kept conductive for a desired time and then it is rendered non-conductive again.

When the electromagnetic valve is rendered closed from its open state, the forward current control auxiliary transistor 5B, the holding current control transistor 5E and the valve opening control transistor 5A, in the majority of causes the transistor 5A having already been non-conductive at this time, are rendered non-conductive, while, at the same time, the backward current control auxiliary transistor 5C and the backward current control transistor 5D are rendered conductive and kept in the conductive state for a desired time. As a result, a current flows backwards from the electric power supply terminal 1 to earth through the backward current control auxiliary transistor 5C, the backward current control transistor 5D and the electromagnetic coil 2.

FIG. 6*d* shows the wave form of the current flowing through the electromagnetic coil 2. In the wave form, the transient characteristic of the current due to the inductance of the electromagnetic coil and the like is neglected. FIG. 6*e* shows the opening and closing state of the electromagnetic valve, in which the responsiveness of the valve is also neglected. Thus, the same effect on the control operation is obtainable as discussed in connection with the embodiment shown in FIG. 3.

FIG. 7 shows the function of the two embodied control devices according to the present invention, in which the curves A and B show the responsiveness in valve closing operation when the electromagnetic valve is driven by the control circuits shown in FIGS. 1 and 3 respectively. Additionally, in the process of valve closing operation, the movable member of the valve collides with the fixed member thereof in an elastic manner and bounds repeatedly several times, in the same manner as in the process of valve opening operation. The magnitude and the number of occurrence of the bounds can be reduced to some degree by suitably selecting the magnitude and flowing period of the backward current.

Figure 8:
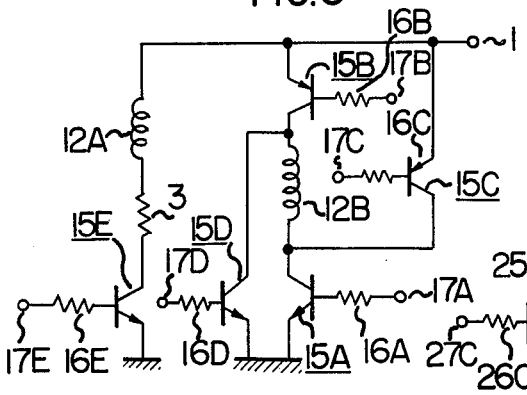

FIG. 8 shows an electric circuit of another embodiment of the invention, in which an electromagnetic coil 12A for holding the open state of an electromagnetic valve, a holding current limiting resistor 3 and a holding current control transistor 15E are connected in series between an electric power supply terminal 1 and earth. Further, a series circuit consisting of a valve opening control auxiliary transistor 15B, an electromagnetic coil 12B for opening the electromagnetic valve and a valve opening control transistor 15A is also connected between the terminal 1 and earth. Transistors 15C and 15D are connected in parallel relation with the series portion consisting of the electromagnetic coil 12B and the transistor 15B and the series portion consisting of the electromagnetic coil 12B and the transistor 15A, respectively. The base electrodes of the transistors 15A, 15B, 15C, 15D and 15E are connected to control signal input terminals 17A, 17B, 17C, 17D and 17E through resistors 16A, 16B, 17C, 16D and 16E respectively.

The holding current control transistor 15E, the valve opening control transistor 15A and the valve opening control auxiliary transistor 15B are respectively controlled to function in agreement with the patterns shown in FIG. 6*a*, FIG. 6*b* and FIG. 6*b*. The circuit is arranged in the manner so that the electromagnetic attraction force due to the current flowing through the electromagnetic coil 12B additionally co-operates with the electromagnetic attraction force due to the holding current which flows through the electromagnetic coil 12A. Further, the backward current control auxiliary transistor 15C and the backward current control transistor 15D are both controlled to function is agreement with the pattern shown in FIG. 6*c*. Thus arranged and controlled, the circuit shows the same effect on the control operation as the circuit of FIG. 5.

Figure 9:
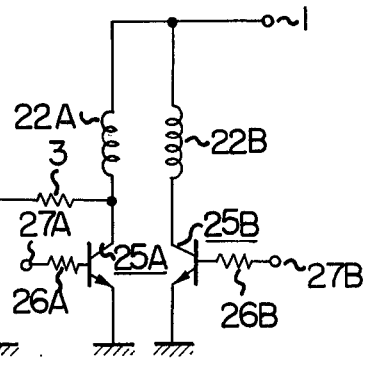

In the circuit shown in FIG. 9, a series circuit consisting of a valve opening control electromagnetic coil 22A and a valve opening control transistor 25A and another series circuit consisting of a backward flux control electromagnetic coil 22B and a backward flux control transistor 25B are connected in parallel relation between an electric power supply terminal 1 and earth. A series circuit consisting of a holding current limiting resistor 3 and a holding current control transistor 25C is further connected in parallel with the collector-emitter circuit of the transistor 25A. The base electrodes of the transistors 25A, 25B and 25C are connected to control signal input terminals through resistors 26A, 26B and 26C respectively.

The holding current control transistor 25C, the valve opening control transistor 25A and the backward flux control transistor 25B are respectively controlled to function in agreement with the patterns shown in FIGS. 6*a*, 6*b* and 6*c*. The coils are arranged in the device so that the magnetic flux produced by a current flowing in the electromagnetic coil 22B during the conduction of the transistor 25B cancels the magnetic flux which is induced by cutting off the current flowing in the electromagnetic coil 22A during the conduction of the transistor 25A and/or transistor 25C, whereby the same effect on the control operation can be obtained as the circuit of FIG. 5.

Figure 10:
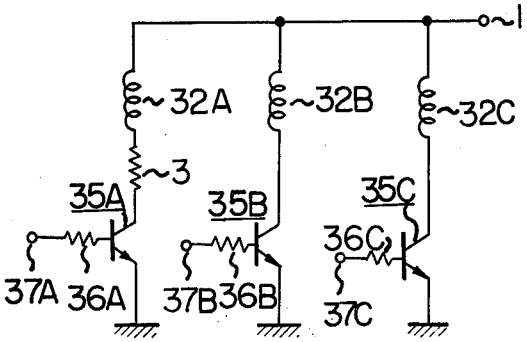

In the circuit of FIG. 10, a series circuit consisting of a holding electromagnetic coil 32A, a holding current limiting resistor 3 and a holding current control transistor 35A, another series circuit consisting of a valve opening electromagnetic coil 32B and a valve opening control transistor 35B and still another series circuit consisting of a backward flux control electromagnetic coil 32C and a backward flux control transistor 35C are connected in parallel relation between an electric power supply terminal 1 and earth, while the base electrodes of the transistors 35A, 35B and 35C are respectively connected control signal input terminals 37A, 37B and 37C through resistors 36A, 36B and 36C. If the electric and magnetic characteristic of the coil 32A is suitably selected, the holding current limiting resistor 3 may be eliminated.

The holding current control transistor 35A, the valve opening control transistor 35B and the backward flux control transistor 35C are respectively controlled to function in agreement with the patterns shown FIGS. 6*a*, 6*b* and 6*b*. The boils are arranged so that the respective magnetic flux produced by the currents flowing in the electromagnetic coils 32A and 32B additionally co-operate with each other and the magnetic flux produced by the current flowing through the electromagnetic coil 32C cancels both the former magnetic flux, whereby the same effect on the control operation is obtainable as stated in connection with the embodied circuit of FIG. 5.

Assuming that, in the circuit of FIG. 10, the holding electromagnetic coil 32A, the holding current limiting resistor 3 and the holding current control transistor 35A are eliminated and the valve opening transistor 35B and the backward flux control transistor 35C are respectively controlled to function in agreement with the patterns of FIGS. 4*a* and 4*b*, and that the electromagnetic coils are arranged so that the magnetic flux produced by the current flowing in the electromagnetic coil 32C cancels the magnetic flux produced by the current flowing in the coil 32B, the same effect on the control operation is obtainable as stated in connection with the circuit of FIG. 3.

FIG. 11 shows an electric circuit of an improved high speed type of fuel feed control device of another embodiment of this invention.

In the circuit of FIG. 11, a series circuit consisting of transistors 45B and 45D and another series circuit consisting of 45C and 45A are connected in parallel between an electric power supply terminal 1 and earth, a valve opening-closing control electromagnetic coil 42A is connected between the junction point of the two collector electrodes of the transistors 45A and 45C and the junction point of the two collector electrodes of the transistors 45B and 45D, and a series circuit consisting of a resistor 3 and a holding current control coil 42B is connected in parallel with the emitter-collector circuit of the transistor 45B. Further, the coils are arranged in a manner so that the magnetomotive force due to the current flowing from the terminal 1 to earth through the resistor 3, the holding current control coil 42B and the transistor 45D and the magnetomotive force due to the current flowing from the terminal 1 to earth through the transistor 45C, the valve opening closing control coil 42A and the transistor 45D co-operate additionally with each other.

In the thus arranged circuit, when the transistors 45A, 45B, 45C and 45D are controlled, respectively, so as to function in agreement with the patterns of FIG. 12*c*, FIG. 12*c*, FIG. 12*b* and FIG. 12*a* by supplying the respective base electrodes of the transistors with required control signals through resistors 46A, 46B, 46C and 46D from control signal input terminals 47A, 47B, 47C and 47D, the circuit functions to produce a magnetomotive force in agreement with the pattern shown in FIG. 12*d* neglecting the transient state thereof. Therefore, the same effect on the control operation is obtainable as shown in FIG. 6*d* and the electromagnetic valve is controlled to operate in agreement with the pattern shown in FIG. 12*e*.

This circuit according to the invention has the advantage in that not a large current is required to pass through the holding current control coil 42B, because the coil 42B is not required so steep in the rising characteristic of the current so that the number of turns in the coil can be much increased by using a fine conductive wire.

Further, if a coil material or the number of turns in the coil is suitably selected, the resistor 3 may be eliminated.

Furthermore, in this control device, the holding current control coil 42B requires no special control element in the circuit.

Referring to FIG. 13, the fuel is led into the opening of a core 121 through a suitable connection pipe and, then, it is further led through the respective hollow portions of an adjuster 124 and a needle 133 and the side hole of the needle 133 to a seat portion composed of a nozzle 134 annd the needle 133. Besides this, the fuel may reach the seat portion through the outer periphery of the needle 133. An actuator 131 is attracted upward in the drawing by an electromagnetic force, so that thhe seat is open to feed the fuel.

The magnetic circuit of this device is composed of the core 121, a yoke 128, the needle 133 and the actuator 131. An electromagnetic coil is usually wound on a coil bobbin collectively in one piece for forming a magnetic field in a conventional fuel injection valve. On the other hand, according to the present invention, an electromagnetic coil 127A for holding the open state of the valve is wound on the inside or outside of a coil bobbin 126 and then insulated with an insulating material. After insulating the coil 127A, another electromagnetic coil 127B for controlling the opening-closing operation of the valve is wound outside or inside of the insulator 129. Accordingly, each of the coils 127A and 127B can produce a magnetic field independently.

The number of turns of the holding coil 127A can be increased to decrease the required current flowing therethrough and the rising characteristic in the transient period of the current flowing through the valve opening-closing control coil 127B can be improved by utilizing relatively thick wire as a widing material and decreasing the number of turns thereof. Depending on the construction of a control circuit, each one of the two terminals of the respective coils 127A and 127B may be commonly used as one terminal, so that the four terminals of the two coils are reduced to three terminals 123A, 123B and 123C as shown in FIG. 14 to thereby enable the wiring in the device to be simplified.

One of the structural features of fuel injection according to the present invention is in the mechanism for adjusting the responsiveness of the injection valve. The adjustment of the responsiveness of the valve has been performed by adjusting the reaction force of a spring in a injection valve of this kind. A method has been proposed for adjusting the reaction force of a spring, in which an adjuster for pushing the spring is screwed into a core, then suitably adjusted after the injection valve is assembled, and the outer periphery of the core is caulked from the outside thereof.

However, this method has a disadvantage in that the adjusted state may be disturbed by absorbing a play of the screw portion or the like when a caulking force is applied, because there is a limit in the accuracy of a screw in general.

According to the present invention, the outer periphery of the adjuster 124 and the inner periphery of the core 121 are precisely finished so that the adjuster 124 is slidable smoothly in the core 121. The fine finish can be easily achieved because of the circular section of the core and the adjuster. When the injection valve is assembled, the adjuster is properly adjusted by a suitable additionally adjusting means before a filter 122 is added into the core 121 and then the adjusted state is fixed by applying a caulking force from the outside of the core 121. Therefore, the problem of the disturbance in adjustment due to the inacuracy of a screw can be solved according to the present invention.

Referring to FIGS. 15 and 16, an input terminal 60 receives an incoming signal having such a wave form (*a*) as shown in FIG. 16 from a known fuel injection control device. The pulse width of the incoming signal represents the period for feeding the fuel, accordingly the fuel feed quantity becomes larger as the pulse width becomes larger. On one hand, the incoming signal is differentiated by a differentiating circuit 66 to be a differentiated signal having such a wave form (*c*) as shown in FIG. 16. On the other hand, the incoming signal is inverted by an inverter 62 so as to have such a wave form (*b*) as shown in FIG. 16. The inverted signal having the wave form (*b*) is then differentiated by a differentiating circuit 64 to be a signal having such a wave form (*d*) as shown in FIG. 16. The output of the differentiating circuit 64 is applied to a monostable multivibrator 68, which produces in turn a signal having such a wave form (*e*) as shown in FIG. 16 in response to the negative output signal of the differentiating circuit 64. Generally, a monostable multivibrator has two switching transistors. In the embodiment of FIG. 15, "Q" represents an output of a transistor which is normally in "ON" state and "$\overline{Q}$" an output of a transistor which is normally in "OFF" state and becomes in "ON" state in response to an input signal applied thereto. The output signal (*c*) as shown in FIG. 16 of the differentiating circuit 66 is applied to monostable multivibrators 70 and 72 which produce signals having such wave forms (*f*) and (*g*) as shown in FIG. 16 respectively in response to the negative pulse applied from the differentiating circuit 66. The input terminals 7E and 7B are respectively connected to the outputs "$\overline{Q}$" and "Q" of the monostable multivibrator 72. When the incoming signal (*a*) of FIG. 16 for instructing the fuel feed is not applied to the monostable multivibrator 68, the output "$\overline{Q}$" of the multivibrator 68 is in the low level to turn on the transistor 5B and the output "Q" of the same is in the high level to turn on the transistor 5E thereby to allow the current (*c*) of FIG. 6 to flow. The output "Q" of the multivibrator 68 is connected to the input terminal 7A. The transistor 5A is turned on in response to the output "Q" of the multivibrator 68 which is actuated by the rising portion of the fuel feed instructing signal (*a*) of FIG. 16, so that the electromagnetic valve is rendered open. Further, the outputs "Q" and "$\overline{Q}$" of the monostable multivibrator 70 are respectively connected to the input terminals 7D and 7C. When the trailing portion of the fuel feed instructing signal (*a*) of FIG. 16 is applied to the input terminal 60, a current is caused to flow through the electromagnetic coil 2 in the direction opposite to the direction of the current which flows in the coil 2 when the valve is rendered open. Thus, the valve may be opened and closed rapidly.

In the embodiment of FIG. 8, the input terminals 17A and 17B are respectively connected to the outputs "Q" and "$\overline{Q}$" of the monostable multivibrator 68 and the input terminals 17C and 17D are respectively connected to the outputs "$\overline{Q}$" and "Q" of the monostable multivibrator 70, and the input terminal 17E is connected to the output "$\overline{Q}$" of the monostable multivibrator 72. When the fuel feed instructing signal is not applied to the input terminal 60, the transistor 15 is in the conductive state and a current which is not large enough to open the valve flows in the coil 12A. Now, when the fuel feed instructing signal is applied to the terminal 60, a current flows through the coil 12B during the period which is determined by the output pulse width of the monostable multivibrator 68 and the electromagnetic valve is reduced open. Next, when the trailing portion of the fuel feed instructing signal is applied to the terminal 60, the transistors 15C and 15D are rendered conductive by the output of the monostable multivibrator 70 to allow the energy stored in the coil 12B to disappear.

In the embodyment of FIG. 9, terminals 27A, 27B and 27C are respectively connected to the output "Q" of the monostable multivibrator 68, the output "Q" of the multivibrator 70 and the output "$\overline{Q}$" of the multivibrator 72. When the fuel feed instructing signal is not applied to the terminal 60, the transistor 25C is in the conductive state and a current which is not large enough to open the valve flows through the coil 22A. Next, upon the application of the fuel feed instructing signal to the terminal 60, the transistor 25A is rendered conductive during the period which is determined by the output pulse width of the multivibrator 68 and the valve is rendered open. Further, upon the application of the trailing portion of the fuel feed instructing signal to the terminal 60, the transistor 25B is rendered conductive during the period of the pulse width of the output "Q" of the monostable multivibrator 70 to allow the energy stored in the coil 22A to disappear.

In the embodiment of FIG. 10, the input terminals 37A, 37B and 37C are respectively connected to the output "$\overline{Q}$" of the monostable multivibrator 72, the output "Q" of the monostable multivibrator 68 and the output "Q" of the monostable multivibrator 70. In the embodiment of FIG. 11, the input terminals 47A, 47B, 47C and 47D are respectively connected to the outputs "Q" and "$\overline{Q}$" of the multivibrator 70, the output "$\overline{Q}$" of the multivibrator 68 and the output "$\overline{Q}$" of the multivibrator 72.

In the embodiment of FIG. 5, 9, 10 and 11, as described above, a current which is not large enough to open the valve is allowed to flow through the electromagnetic coil prior to the application of the fuel feed instructing signal so that the valve may be rapidly opened when the fuel feed instructing signal is applied to the input terminal. Further, in closing the valve, a current is caused to flow through the coil in the direction opposite to the current which flows when the valve is opened, so that the valve closing operation may be effected rapidly.

I claim:

1. A fuel feed control device for an internal combustion engine comprising:

a normally closed fuel injection valve for controlling the fuel quantity to be fed to the engine according to the opening duration thereof:

spring means provided on said valve for applying a biasing force to said valve to urge said valve toward its closed position;

valve control means for electromagnetically controlling the opening and closing operation of said valve; and said valve control means including electromagnetic coil means, a first means including a first circuit for enabling a first current to flow through said coil means for producing a first electromagnetic attraction force, a second means including a second circuit for enabling a second current to flow through said coil means for producing a second electromagnetic attraction force, and a third means including a third circuit for enabling a third current to flow through said coil means for producing backward magnetic flux, said first electromagnetic attraction force being insufficient to open said valve from its closed state against said biasing force but large enough to hold said valve in its open state against said biasing force after said valve has been once opened, said second electromagnetic attraction force being such that the sum of said first and second electromagnetic attraction forces is large enough to open said valve from its closed state, said backward magnetic flux being for cancelling magnetic flux which is induced when said first electromagnetic attraction force is obviated to close said valve from its open state and which acts to prevent said first electromagnetic attraction force from disappearing, said first means being actuated to produce said first electromagnetic attraction force at least for a period across the pulse width of an incoming external demand pulse which instructs the fuel quantity to be fed by said valve, said second means being actuated to produce said second electromagnetic attraction force in addition to said first electromagnetic attraction force at least for a period from the beginning of the pulse width of said demand pulse to the completion of the valve opening operation, said third means being actuated to produce said backward magnetic flux upon the end of the pulse width of said demand pulse, said first circuit comprising a first series circuit including said coil means, a resistor and a first switching means; said second circuit comprising a second series circuit including said coil means, a capacitor, and a second switching means; and said third circuit comprising a third series circuit including said coil means and a third switching means, said first, second and third switching means being actuated in response to said demand pulse.

2. A fuel feed control device according to claim 1, wherein said coil means includes a single winding; said valve control means includes a first, a second, a third and a fourth transistor; said first transistor, said winding, said resistor and said second transistor are connected in series with each other in this order to form said first series circuit between a pair of terminals which are adapted to be connected, in use, to an electric source; said first transistor, said winding, said capacitor and said second transistor are connected in series with each other in this order to form said second series circuit between said pair of terminals; and said third transistor, said winding and said fourth transistor are connected in series with each other in this order to form said third series circuit between said pair of terminals.

* * * * *